United States Patent [19]

Flowerday

[11] 4,189,804

[45] Feb. 26, 1980

[54] BACK PLATE AND BAIL ASSEMBLY

[75] Inventor: Dale L. Flowerday, Holland, Mich.

[73] Assignee: Keeler Corporation, Grand Rapids, Mich.

[21] Appl. No.: 889,737

[22] Filed: Mar. 24, 1978

[51] Int. Cl.[2] ..... A47B 95/02

[52] U.S. Cl. ..... 16/126; 190/58 R

[58] Field of Search ..... 16/126; 190/39, 57 R, 190/58 R, 58 A; 220/94 R

[56] References Cited

U.S. PATENT DOCUMENTS

| | | | |
|---|---|---|---|
| 3,451,590 | 6/1969 | Johnson et al. | 190/57 |
| 4,056,864 | 11/1977 | Driesenga | 16/126 |

FOREIGN PATENT DOCUMENTS

| | | | |
|---|---|---|---|
| 52013 | 1/1933 | Norway | 16/126 |

*Primary Examiner*—George H. Krizmanich

*Attorney, Agent, or Firm*—Price, Heneveld, Huizenga & Cooper

[57] ABSTRACT

This specification discloses a back and bail assembly adapted for ease of joining and separating the bail and back member. Each of the two legs of the bail or handle includes a pintle or projection extending laterally to one side to be engaged by a recess in one of two opposing walls in the back member. At least one of the legs has a relief, or cut away corner, on the opposite side of the leg from the projection to facilitate insertion of the leg between the two opposing walls when the bail is in a generally lowered position parallel to the front face of the back member. However, when the bail is lifted and force is applied to pull the bail and back member outward, the full width of the front face of the bail is positioned between the opposing walls of the back member thus preventing accidental removal of the bail from the back member.

25 Claims, 18 Drawing Figures

BACK PLATE AND BAIL ASSEMBLY

BACKGROUND OF THE INVENTION (1) Field of the Invention

This invention relates to furniture hardware and, more particularly, to a back and bail assembly for use as a furniture pull which is uniquely adapted for ease of coupling and uncoupling between the bail and the back member.

(2) Prior Art

It is common to provide furniture hardware, such as pulls for drawers, cabinet doors and the like, with handles having at least a pair of legs and means for pivotally securing each of the legs to a furniture component. For example, the securing means for the handle can include a back member having a channel for receiving the handle and an opening in the side thereof for receiving pintles or projections from the handle so that the handle may be pivoted thereabout.

A particular problem has been encountered in assembling such a handle and back member. Typically, the channel must be sufficiently wide to accommodate the full width of the leg and projection about which pivoting takes place. The projection is typically secured within the opening for pivoting by deflecting the handle to position the leg and protrusion within the channel and then releasing the handle so the pins are positioned in the opening. Of course, it can be appreciated that subsequent deflection of the handle can remove the projection from the opening and release the handle from the back member. Such a deflecting force can be encountered, and in fact commonly occurs, when the handle is used to pull the furniture component. Indeed, just at the time when it is desired that the handle transmits a force to the back member and in turn to the furniture component, the handle can deflect causing the projection to pull out of the opening releasing the handle. Generally it has been difficult to provide a back and bail assembly for furniture pulls in which the bail and back member are easily assembled and yet provide adequate support coupling the bail and back member when a pulling force is applied to the bail.

The present invention provides a unique solution to the above problem in that the assembly provides ready coupling between the bail and back member and positive resistance to uncoupling between the bail and back member when the handle is pivoted for pulling the furniture component such as a drawer, and a force is applied to the handle. The invention provides the visual impression that the bail cannot be removed from the back member without substantially destroying the assembly. In fact, assembly and disassembly of the bail and back member can be readily accomplished when the bail is properly positioned with respect to the back member, and a moderate, properly directed force is applied to the bail member.

SUMMARY OF THE INVENTION

The present invention provides a back and bail assembly for furniture pulls and the like comprising a bail or handle having a pair of legs and a back member for pivotally securing the bail to furniture. The assembly is unique in that a leg of the bail or handle can be deflected and inserted into a channel in the back member in a position where, typically, the bail need not sustain a pulling force; and, a positive force resisting decoupling of the bail and back member is present when the bail is in a position at which typically pulling forces are applied to the furniture component.

The bail is generally U-shaped so as to provide a pair of legs, each of which is received within correspondingly shaped recesses of the back member. At the end of each leg is projection means for pivotally attaching the leg to the back member within the recesses. Each recess includes two spaced side walls and a back wall. In each of the recesses is an opening for receiving a projection means on the leg for pivotally attaching the leg to the back member.

One of the legs is formed so that when the bail is positioned in approximate stored position with respect to the back plate, the bail can be flexed causing the projection on that leg to be moved out of the opening in which it is normally pivotally mounted. However, when the bail is pivoted to a position for moving the component of furniture, such as a drawer or a door, the bail cannot be flexed so as to draw the pivotal connection from its opening. As a result, the projection from the bail remains secured within the recess in the back and the bail remains coupled to the back member so a force can be applied to the furniture component. An assembly in accordance with an embodiment of this invention provides an appearance of overall solid quality because the exterior appearance of the bail and back assembly does not reveal that the bail and back member can be readily uncoupled. Such quality is enhanced by the solid coupling between the bail and the back member when the bail is lifted to apply a pulling force.

DETAILED DESCRIPTION OF THE INVENTION

Figure 1:
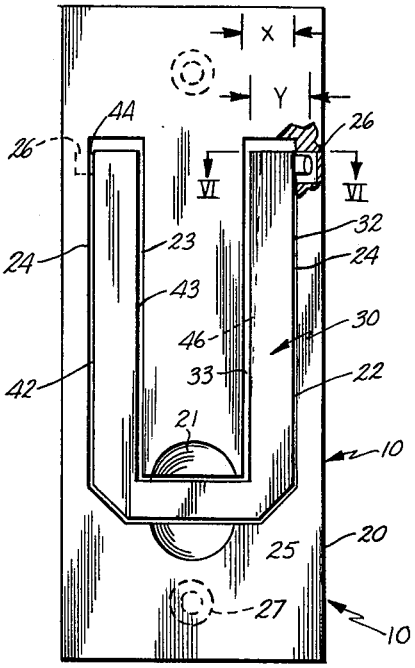
FIG. 1 is a front elevation view, partly broken away, of a bail and back assembly in accordance with an embodiment of this invention.
Figure 4:
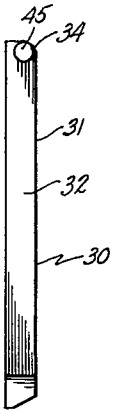
FIG. 4 is a side elevation view taken generally along the plane IV—IV of FIG. 2.
Figure 2:
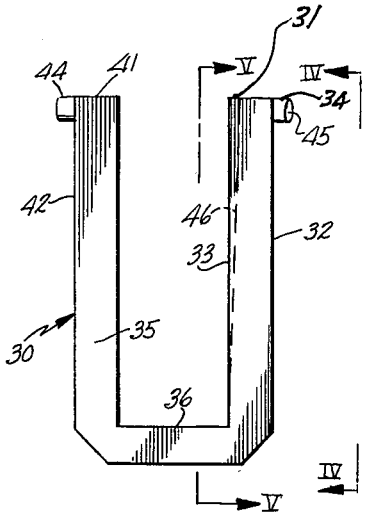
FIG. 2 is a front elevation view of a bail constructed in accordance with an embodiment of this invention.

Referring to the drawings, FIGS. 1, 10, 11 and 12 show a back and bail assembly 10 having a back member 20 and a bail or handle portion 30 pivotally coupled to back member 20. Bail 30 has a generally U-shaped configuration including generally parallel leg members 31 and 41 each having inner sides 33 and 43, respectively, and an outer side 32 and 42, respectively. On each outer side 32 and 42 near the extremity of each leg member 31 and 41 are cylindrical pins or stud projections 34 and 44, respectively, extending only to one side of the leg, formed integrally with the leg members and extending beyond outer sides 32 and 42, respectively (FIGS. 2–5). Cylindrical pins 34 and 44 are generally coaxial with each other and provide a pivot axis for bail 30 which is rotated thereabout by grasping bail 30 at an indentation 21 within back member 20 when bail 30 is assembled with back member 20. Back member 20 includes a channel or recess 22 generally shaped to receive bail 30 with the aforementioned indentation 21 to provide easy grasping access to bail 30. Each leg of channel 22 has a pair of opposing side walls 23 and 24 (FIG. 1).

As best seen in FIGS. 2–5, leg members 31 and 41 of bail 30 lie in the same plane and have a front face 35. Cylindrical pins 34 and 44 are positioned on and extend outwardly from the outer sides 32 and 42, respectively. Cylindrical pin 34 has a planar inclined end 45 generally in the shape of an ellipse. As a result, cylindrical pin 34 has a rear portion extending further outwardly from side 32 than the front portion of cylindrical pin 44. Advantageously, for reasons further discussed below, the shortest side of pin 34 faces forward when bail 30 is located in the recess 22.

Figure 3:
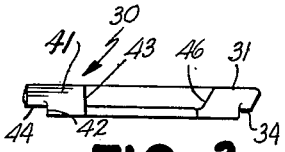
FIG. 3 is a top plan view of a bail in accordance with an embodiment of this invention.
Figure 5:
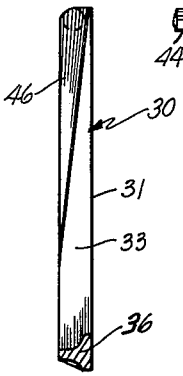
FIG. 5 is a side elevation view, in part sectional, taken generally along plane V—V of FIG. 2.
Figure 6:
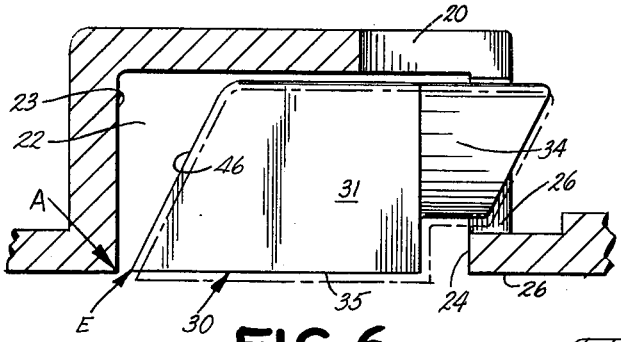
FIG. 6 is a partial sectional view taken generally along plane VI—VI of FIG. 1 with a bail installed in the back member in accordance with an embodiment of this invention.
Figure 7:
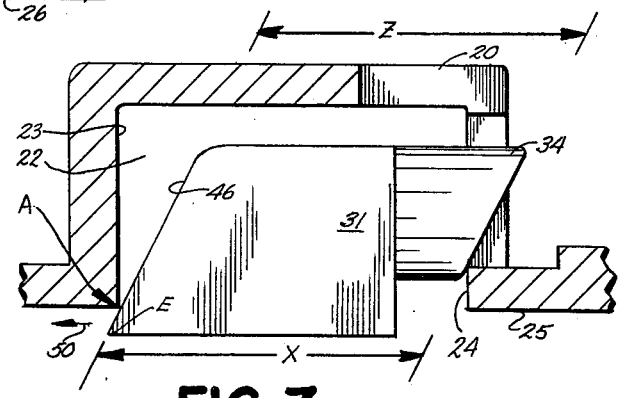
FIGS. 7 and 7A are views similar to FIG. 6 but showing the bail being progressively displaced forwardly and flexed to the left so as to remove the leg and its projection from the back member.
Figure 8:
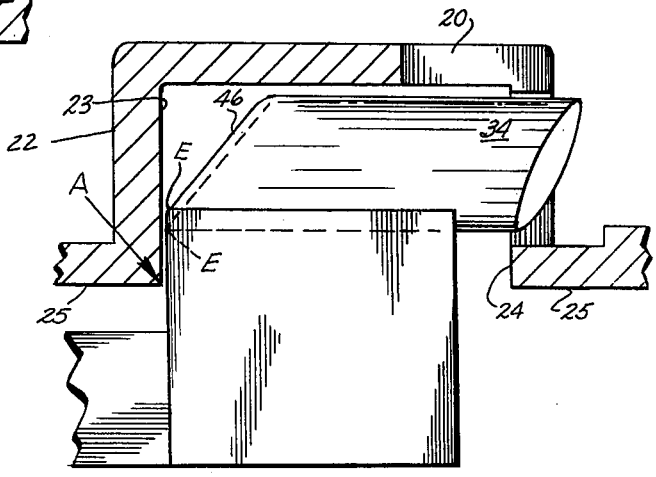
FIG. 8 is a view similar to FIG. 6 with the bail pivoted about 30 degrees to a position in which the bail is prevented from being withdrawn from the back member.

The inner side 33 includes a relief 46 which is more clearly seen in FIGS. 6, 7 and 8. Thus, while legs 31 and 41 have a generally rectangular cross section, the presence of relief 46 removes one corner of leg 31 along a longitudinal portion of leg 41 best seen in FIG. 5 where the generally triangular shape of relief 46 is visible. Outer side 42 and inner side 43 of leg member 41 are generally parallel so leg member 41 has a generally constant cross section (FIG. 3). In contrast, leg member 31 has a generally trapezoidal cross section (FIGS. 7 and 8) which tends toward a generally rectangular cross section as sections are taken further down leg member 31 away from cylindrical pin 34. If desired, relief 46 can be curvilinear and have a concave surface extending into leg member 41. As shown in FIG. 5, a connecting portion 36 between leg members 31 and 41 has a generally triangular cross section to facilitate grasping of bail 30.

Figure 9:
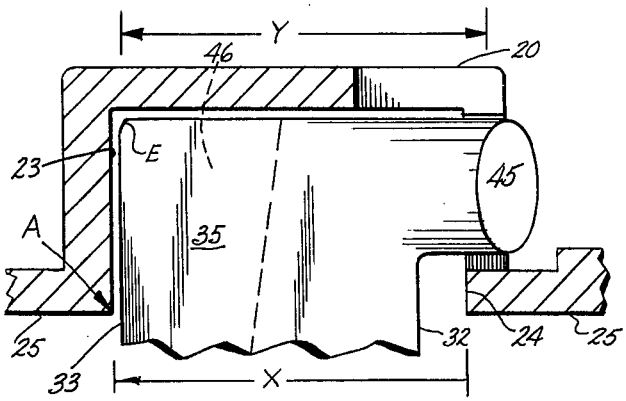
FIG. 9 is a view similar to FIG. 8 in which the bail is pivoted 90 degrees to a position in which the bail is prevented from being withdrawn from the back member.
Figure 13:
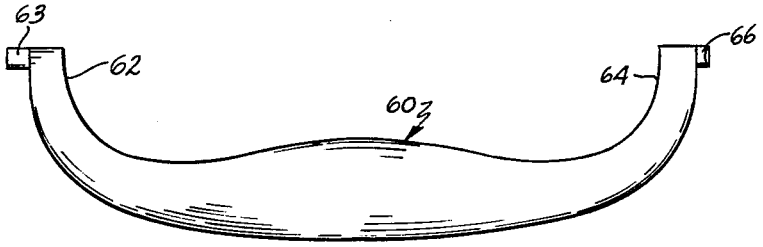
FIG. 13 is a front elevational view of a modified bail incorporating the present invention.

As best seen in FIG. 1, back member 20 has a front face 25 wherein is formed a recess or channel 22. Each outer wall 24 of the recess or channel 22 has an opening 26 for receiving cylindrical pins 34 and 44. Referring to FIGS. 1 and 9, the width dimension X of channel 22 at the position of recessed opening 26 is less than the combined width (Y) of front face 35 and the length of cylindrical pin 34. As disclosed in FIG. 6, recessed openings 26 have sufficient depth, in a direction perpendicular to front face 25, so that back member 20 can be in the same plane as front face 35 of bail 30. Additionally, as disclosed in phantom lines in FIG. 6, recessed opening 26 extends far enough so front face 35 of bail 30 can extend somewhat forward of front face 25 of back member 20. Referring to FIG. 7, it will be noted that once the edge E of bail leg 31 passes the edge A of channel 22, the combined length of cylindrical pin 34 and the width of leg member 31 at the rearmost section measured at Z is less than the width of channel 22 measured at W.

Figure 10:
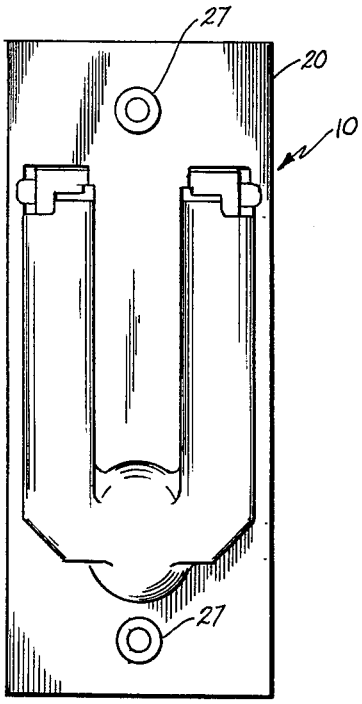
FIG. 10 is a rear elevation view of a bail and back assembly in accordance with an embodiment of this invention.
Figure 11:
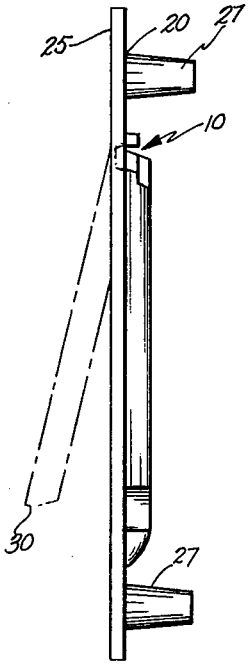
FIG. 11 is a side elevation view of the bail and back assembly shown in FIG. 10 and includes, in phantom, the position of a bail prior to deflection and removal.
Figure 12:
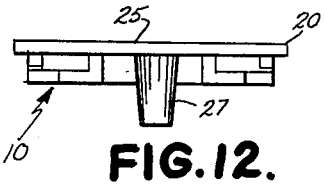
FIG. 12 is a top plan view of the bail and back assembly shown in FIG. 10.

Referring to FIGS. 10, 11, and 12, a pair of hollow screw receiving posts 27 extend backward from the rear of back member 20 for receiving screws to attach back member 20 to a furniture component. Posts 27 have internal threads and are spaced along the length of back member 20.

Preferably, bail 30 and back member 20 are die cast from zinc or a similar metal. Casting allows the various projections to be easily and inexpensively formed without time consuming and expensive machinery and milling operations.

ASSEMBLY

Installing of bail 30 to back member 20 starts by installing leg member 41 into recessed opening 26 so that cylindrical pin 44 goes into recessed opening 26 as shown in FIG. 1. This is relatively easy to accomplish because bail 30 is unattached at the other end and can be easily oriented to obtain such an insertion. After leg 41 is pivotally secured, leg 31 is to be inserted. However, because bail 30 is no longer free to orient as desired, it is through use of this invention that leg 41 can be easily installed to back member 20. This invention also facilitates removal of bail 30 from back member 20 so that leg member 31 is first removed from back member 20 and then leg member 41 is removed. Such assembly and disassembly of bail 30 with back member 20 is most easily discussed when referring to FIGS. 6, 7, 7A, 8 and 9.

Figure 7A:
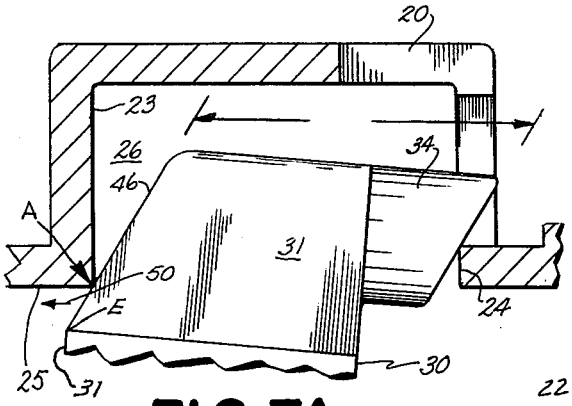

The installing and removal of leg member 31 to back member 20 occurs when bail 30 is in a position shown in phantom in FIG. 11 so that bail 30 is generally down in a position where a pulling force would not be typically applied. In such position the bail is spaced from back member 20 to facilitate grasping of leg 41. Assuming leg member 31 is already installed, leg member 31 is moved forward to the position shown in phantom in FIG. 6 so that the forward surface of cylindrical pin 34 abuts the forward extremity of recessed opening 26. In this position, the front face 35 of bail 30 is spaced forward of front face 25 of back member 20 so that the edge E of relief 46 can clear the edge A of recess 22 when a force to leg 31, as indicated at arrow 50 of FIG. 7A, is applied to flex leg 31 and relief 46 toward side wall 23. Continued flexing of leg 31 permits the leg and its pin 34 to slide forwardly out of the channel or recess 22. As already noted, the distance Z is less than the distance W and leg 31 can be removed by applying a forward force.

FIGS. 6 and 7 also clearly show the cooperation between end 45 and relief 46. That is, although it is possible to remove leg 31 without having an angled end such as 45, the angle helps cylindrical pin 34 slide with respect to the boundaries of recessed openings 26. Similarly, when leg 31 is being inserted, the rearmost extremity of pin 34 can be initially easily first hooked into recessed opening 26 thereby facilitating insertion of leg 31.

Installation of bail 30 to back member 20 requires performing the above mentioned removal steps in reverse order. Briefly, leg member 41 is installed by positioning cylindrical pin 44 into recessed opening 26. Leg 31 is flexed so that pin 34 slides into channel or recess 22. As leg 31 proceeds into recess 22, relief 46 slides along edge A of recess 22 until edge E of relief 46 is adjacent edge A. Leg 31 is no longer flexed and bail 30 is secured to back member 20.

Even though there can be relatively easy installation and removal of bail 30 and back member 20 when bail 30 is in a relatively lowered position, the pivoting of the bail to a position of 30 degrees or more prevents the bail from being removed. This is best shown in FIGS. 8 and 9 where bail 30 is shown pivoted upwardly approximately 30 and 90 degrees, respectively. As disclosed in FIG. 8, when the bail is pivoted upwardly, the edge E of the bail leg 31 moves into the channel while the pin 34 remains in its original position. Thus, the edge E cannot clear the edge A which prevents flexing of leg 31 and prevents withdrawal of the leg and its pin 34 from the channel. This is accentuated as the bail is pivoted to 90 degrees as is illustrated by FIG. 9.

Figure 16:
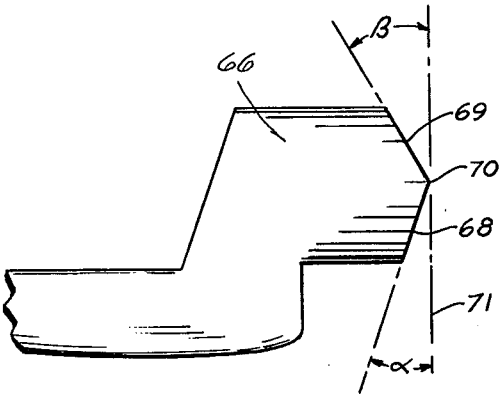
FIG. 16 is an enlarged fragmentary top plan view of the right end of the bail shown in FIG. 13.
Figure 14:
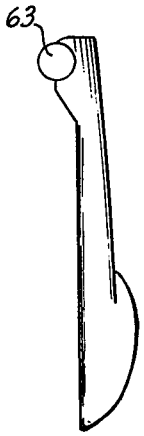
FIG. 14 is a left end view of a bail shown in FIG. 13.
Figure 15:
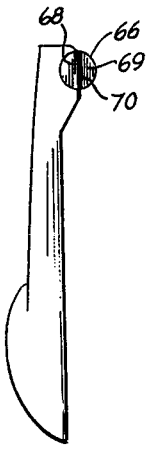
FIG. 15 is a right end view of the bail shown in FIG. 13.

An alternative embodiment of the invention is shown in FIGS. 13 through 17 where there is shown a bail 60 of generally U-shaped construction having a pair of legs 62 and 64 each of which includes a pintle 63 and 66 extending outwardly from the upper ends of the legs. Pintle 63, as best seen in FIG. 14, is a solid, generally cylindrical pin with a flat end while pintle 66, as best seen in FIGS. 15 and 16, is solid and cylindrical but its end has a pair of beveled surfaces 68 and 69 joining at a generally vertically extending intersection 70. As seen in FIG. 16, each of the beveled faces 68 and 69 form angles $\alpha$ and $\beta$, respectively, with an axis 71 perpendicular to the longitudinal axis of the pintle 66. The angle $\alpha$ in the preferred embodiment was approximately 20 degrees while angle $\beta$ was approximately 30 degrees.

Figure 17:
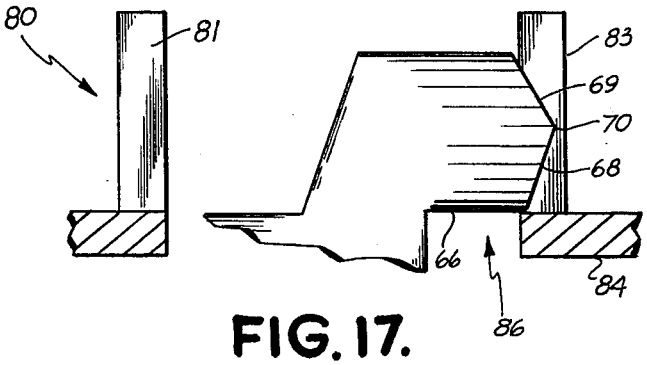
FIG. 17 is an enlarged fragmentary plan view partly in cross section showing the right end of the bail and the associated backing plate in cooperative relationship.

In FIG. 17, a fragmentary portion of a backing plate 80 is also shown. Plate 80 can be of conventional construction or similar to that shown in the previous embodiments but modified in dimension to receive the different shaped bail 60. The only significant change pertains to the right end bail receiving structure now described. Plate 80 includes a front wall 84 having an aperture 86 formed therein to receive the pintle 66. On opposite sides of aperture 86 are a pair of rearwardly projecting vertically extending side walls 81 and 83. Wall 83 includes a semi-circular recess 85 formed to receive the pintle 66. The left side (not shown) of plate 80 is similarly constructed to pivotally receive pintle 63.

Such construction permits the bail with pintle 66 to be relatively easily snapped into an assembled position since surface 69 has a sharper bevel and the pintle is relieved at surface 68 such that once edge 70 clears end 82 of the plate, the pintle easily fits into recess 83 of the side wall. When, however, the bail is lifted, the lineally extending edge 70 is rotated to provide a positive obstruction preventing removal of the pintle 66 from recess 83 of the backing plate. Thus, in all respects, the alternative embodiment functions in the same manner as the previous embodiments but is significantly easier to install by virtue of the intersecting vertically extending beveled surfaces.

Although the above described embodiments describe the relief on only one of the legs of the bail, it is possible to have such reliefs on both legs. Further, the relative positions of the cylindrical pins and reliefs can be reversed so that the pins point inwardly. Still further, the position of the recesses and the pins can be reversed so that the pin is a part of the back member and the recess is a part of the bail. Further modifications and variations will no doubt occur to those skilled in the art to which this invention pertains. These and all other variations which basically rely on the teachings through which this disclosure has advanced the art are properly considered within the spirit and broader aspects of this invention.

The embodiments of the invention in which an exclusive property or privilege is claimed are defined as follows:

1. A bail and back assembly for furniture pulls on a furniture component and the like including a bail and a single back member, said bail being generally U-shaped and having a pair of legs, a first of said legs having a relief or a cutaway portion which in a first position of said bail will permit flexing of said first leg for removal of said first leg from said back member; and said relief or cutaway portion being orientable with respect to said back member to a second position wherein separation of said bail and back assembly and flexing of said first leg is resisted when a pulling force is applied to said bail for pulling on the furniture component.

2. A bail and a back assembly for furniture pulls and the like as recited in claim 1, each of said pair of legs including leg coupling means for pivotally attaching the leg to said back member; said back member including a pair of opposing walls spaced a predetermined distance apart for receiving therebetween a leg of said bail; said walls having a front extremity defining the forwardmost extent of said walls; at least one of said wall surfaces including a back coupling means for coacting with said leg coupling means and pivotally securing said bail to said back member, said first leg of said pair of legs having sides disposed between and generally facing said opposing walls; said first leg having a front face disposed between said sides; said leg coupling means being positioned on a first of said sides; a second of said sides including said relief such that the distance between said sides decreases from front to rear and wherein the combined total width of said leg and said first leg coupling means is less than said predetermined distance separating said sides thus facilitating removal of said bail from said back member when said bail is flexed to align said first leg and leg coupling means with said predetermined distance.

3. A bail and back assembly as recited in claim 2 wherein said leg coupling means includes a projection means extending outward from said first side for establishing a pivot axis for said bail; said projection means being spaced to the rear of said front face; said back coupling means includes a recess in one of said wall surfaces for receiving said projection means; the combined width of said front face and the length of said projection means being greater than the said predetermined distance.

4. A bail and back assembly as recited in claim 3 wherein said projection means includes a generally cylindrical post extending outward from said first leg and has a slanted end face for acting in cooperation with said relief for facilitating removal of said bail from said back; and said slanted end face being such that the back surface of said cylindrical post extends further from said first side than the front surface of said cylindrical post extends from said first side.

5. A bail and back assembly as recited in claim 4 wherein the plane of said slanted end face is positioned with respect to the plane of said front face of said bail so that the shortest length of said cylindrical post is facing forward toward said front extremity of said walls when said bail has been rotated sufficiently to permit grasping of said bail to deflect said first leg thus permitting said first leg and said cylindrical post to pass through said predetermined distance.

6. A bail and back assembly as recited in claim 3 wherein said first leg has a generally quadrilateral cross section beyond said relief and said relief cuts across one of the corners of said first leg thereby reducing the width of said first leg with increasing distance to the rear from said front face.

7. A bail and back assembly as recited in claim 6 wherein said relief is curvilinear as it cuts across the corner thereby forming a generally concave surface.

8. A bail and back assembly as recited in claim 3 wherein said back member includes a generally planar face plate having recessed therein a generally U-shaped channel shaped to receive said bail; said opposing walls defining the sides of said channel at the extremities of said channel; the ends of said channels, between said opposing walls of the extremities of said channel, being positioned to limit pivoting of said bail with respect to said back member by engaging said front face.

9. A bail and back assembly as recited in claim 8 wherein the rear of said face plate includes attachment means for attaching said back member to furniture.

10. A bail and back assembly as recited in claim 8 wherein said channel generally follows the contour of said bail and includes an enlarged portion for permitting placing a finger in said channel and grasping said bail.

11. A bail and back assembly as recited in claim 6 wherein a second leg of said pair of legs has a substantially constant width with increasing distance to the rear from a front face of said second leg, has generally parallel opposing sides, has a projection extending from one of said opposing sides and the combined width of said second leg and said projection is greater than said predetermined distance.

12. A bail for a furniture hardware assembly having a generally U-shape with a pair of legs, said legs each having two opposing sides, a back surface, a front face and projection means located at the ends of said legs and extending from one side for pivotally attaching the bail to a furniture hardware assembly, a first of said legs having at the side opposite said projection means a relief running longitudinally along a portion of said side thereby progressively reducing the width from front to back of the cross section of said first leg at said relief; said projection means being spaced rearwardly of a point at which the reduction in the width of the cross section begins; said bail being flexible; said relief, location of said projection means, and the flexible characteristic of said bail facilitating the installation and removal of said back in a furniture hardware assembly.

13. A bail as recited in claim 12 wherein said projection means includes a generally cylindrical post extending outwardly from said first leg and has a slanted end face for acting in cooperation with said relief for facilitating installation and removal of said bail from said furniture hardware assembly; and said slanted end face being slanted away from said first leg in a direction from front to back.

14. A single back and bail assembly for furniture pulls and the like including a bail and a back member; said bail having a pair of legs, each leg including two opposing sides, a rear surface and a front face with a projection means extending from one of said sides near the ends of said legs for pivotally attaching the bail to said back member; said back member including a pair of spaced, opposing walls, each for receiving therebetween a leg of said bail, at least one of said wall surfaces including a recess for receiving said projection means; said wall surfaces being spaced a predetermined distance apart generally at the position of said recess; said leg, at the position of said projection means having a maximum width between said opposing sides less than said predetermined distance; at least a portion of said projection means projecting into said recess; the combined length of said projection means and said maximum width of said leg being greater than said predetermined distance; the width of said leg between said opposing sides decreasing in magnitude from front to rear providing an edge at which said decreasing width starts, said edge running along a portion of leg from the end thereof; said projection means being spaced rearwardly of said edge and having sufficient movability within said recess so that said edge of said leg can project beyond the front extremity of said wall surfaces; said leg being flexible and the magnitude of the decreasing width of said leg being sufficiently great whereby when said edge has cleared the front extremity of the adjacent wall surface, the leg can be flexed by virtue of the decreasing magnitude of the width of said leg until the combined length of said projection means and the width of said leg, at and to the rear of the front extremity of said wall surfaces, is less than said predetermined width thereby permitting removal of said leg from said backing member.

15. A back and bail assembly as recited in claim 14 wherein said projection means has a slanted end and said leg includes a slanted side opposite from said projection means, said slanted end and slanted side having generally parallel surfaces coacting to permit said leg to pass through said predetermined distance.

16. A bail and back plate assembly for furniture pulls comprising: a generally U-shaped bail with a pair of legs including pintle means extending from ends of each leg for pivotally securing said bail to a back plate; a back plate including means for pivotally capturing said pintle means of said bail, wherein the improvement comprises: said capturing means comprising a pair of spaced walls with recess means for receiving said pintle means, said walls spaced to admit said pintle means in said recess means only when said bail is deflected to slightly change the distance between said pintle means; and wherein one of said pintle means includes a beveled end to facilitate snap-in insertion of said bail to said back plate and resist removal once inserted.

17. The assembly as defined in claim 16 wherein said one pintle means is a solid cylindrical projection extending from an end of one leg of said bail and said beveled end is beveled outwardly from front to back of said bail across the entire face of said beveled end.

18. The assembly as defined in claim 16 wherein said one pintle means is a solid cylindrical projection extending from an end of one leg of said bail and said beveled end includes a pair of bevels intersecting at a generally vertically extending edge and each of said bevels extend inwardly from said edge.

19. The assembly as defined in claim 18 wherein said pair of bevels define front and rear bevels and are at different bevel angles and said edge extends approximately along the center of said cylindrical projection.

20. The assembly as defined in claim 19 wherein said front bevel is at an angle of about 20 degrees to an axis orthogonal to the longitudinal axis of said one pintle means and said rear bevel is at an angle of about 30 degrees to said axis.

21. A bail and back plate assembly for furniture pulls comprising: a generally U-shaped bail with a pair of legs including pintle means extending from a side of each leg for pivotally securing said bail to a back plate; a back plate including fixed spaced means for pivotally capturing said pintle means of said bail, wherein the improvement comprises: said capturing means comprising a pair of spaced walls with recess means for receiving said pintle means, wherein one of said pintle means includes a beveled end to facilitate snap-in insertion of said bail to said back plate, said walls spaced to admit said pintle means and cooperating with said one pintle means in said recess means when said bail is in a lowered position generally flush with said back plate and resists removal of said bail from said back plate once said bail is inserted and when said bail is moved from said lowered position.

22. The assembly as defined in claim 21 wherein said one pintle means is a solid cylindrical projection extending from an end of one leg of said bail and said beveled end is beveled outwardly from front to back of said bail across the entire face of said beveled end.

23. The assembly as defined in claim 21 wherein said one pintle means is a solid cylindrical projection extending from an end of one leg of said bail and said beveled end includes a pair of bevels intersecting at a generally vertically extending edge and each of said bevels extend inwardly from said edge.

24. The assembly as defined in claim 23 wherein said pair of bevels define front and rear bevels and are at different bevel angles and said edge extends approximately along the center of said cylindrical projection.

25. The assembly as defined in claim 24 wherein said front bevel is at an angle of about 20 degrees to an axis orthogonal to the longitudinal axis of said one pintle means and said rear bevel is at an angle of about 30 degrees to said axis.

* * * * *

UNITED STATES PATENT AND TRADEMARK OFFICE

CERTIFICATE OF CORRECTION

PATENT NO. : 4,189,804

DATED : February 26, 1980

INVENTOR(S) : Dale L. Flowerday

It is certified that error appears in the above-identified patent and that said Letters Patent are hereby corrected as shown below:

Column 8, claim 14, line 1:

Before "back" delete "single"

Column 8, claim 14, line 2:

Before "back" insert --single--

Signed and Sealed this

*First* Day of *July 1980*

[SEAL]

*Attest:*

SIDNEY A. DIAMOND

*Attesting Officer*

*Commissioner of Patents and Trademarks*